US011666964B2

(12) United States Patent
Sakaguchi et al.

(10) Patent No.: US 11,666,964 B2
(45) **Date of Patent: *Jun. 6, 2023**

(54) FLASKLESS MOLDING MACHINE

(71) Applicant: SINTOKOGIO, LTD., Nagoya (JP)

(72) Inventors: Koichi Sakaguchi, Toyokawa (JP); Tokiya Terabe, Toyokawa (JP); Tatsumi Fujita, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 277 days.

This patent is subject to a terminal disclaimer.

(21) Appl. No.: 16/301,824

(22) PCT Filed: May 12, 2017

(86) PCT No.: PCT/JP2017/018067

§ 371 (c)(1),
(2) Date: Nov. 15, 2018

(87) PCT Pub. No.: WO2017/199881

PCT Pub. Date: Nov. 23, 2017

(65) Prior Publication Data

US 2019/0168291 A1 Jun. 6, 2019

(30) Foreign Application Priority Data

May 17, 2016 (JP) ..... JP2016-098759

(51) Int. Cl.
*B22C 11/10* (2006.01)
*B22C 15/24* (2006.01)
(Continued)

(52) U.S. Cl.
CPC ..... *B22C 11/10* (2013.01); *B22C 9/02* (2013.01); *B22C 15/24* (2013.01); *B22C 15/28* (2013.01); *B22D 33/04* (2013.01); *B22C 19/04* (2013.01)

(58) Field of Classification Search
CPC ..... B22C 11/10; B22C 15/08; B22C 15/24; B22C 15/28
See application file for complete search history.

(56) References Cited

U.S. PATENT DOCUMENTS 3,822,737 A * 7/1974 Edwards ..... B22C 5/0472 164/22
4,034,795 A * 7/1977 Otaki ..... B22C 11/10 164/173
4,840,218 A 6/1989 Hunter
5,246,058 A * 9/1993 Murata ..... B22C 11/10 164/182
2012/0328727 A1* 12/2012 Takasu ..... B22C 15/02 425/176

FOREIGN PATENT DOCUMENTS

CN 101862815 A 10/2010
CN 104128571 A 11/2014
(Continued)

OTHER PUBLICATIONS

International Preliminary Report on Patentability dated Nov. 29, 2018 for PCT/JP2017/018067.

*Primary Examiner* — Kevin E Yoon
*Assistant Examiner* — Jacky Yuen
(74) *Attorney, Agent, or Firm* — Faegre Drinker Biddle & Reath LLP

(57) ABSTRACT

A flaskless molding machine includes: an upper sand tank storing the mold sand to be supplied to the upper molding space; a first lower sand tank storing the mold sand to be supplied to the lower molding space, and having a first communication port for discharging the stored mold sand; a second lower sand tank having a second communication port capable of communicating with the first communication port of the first lower sand tank, and storing the mold sand supplied from the first lower sand tank and to be supplied to the lower molding space; at least one first guide member
(Continued)

extending in a vertical direction, and guiding the upper flask, the lower flask and the second lower sand tank in the vertical direction; and a second guide member extending in the vertical direction, and guiding the first lower sand tank in the vertical direction.

19 Claims, 10 Drawing Sheets

(51) Int. Cl.

| | |
|---|---|
| ***B22C 9/02*** | (2006.01) |
| ***B22C 15/28*** | (2006.01) |
| ***B22D 33/04*** | (2006.01) |
| ***B22C 19/04*** | (2006.01) |

(56) References Cited

FOREIGN PATENT DOCUMENTS

| | | | | | |
|---|---|---|---|---|---|
| EP | 0779118 | A1 | | 6/1997 | |
| EP | 3 427 861 | B1 | | 9/2020 | |
| GB | 2059836 | A | | 4/1981 | |
| JP | 58068453 | A | * | 4/1983 | ..... B22C 15/28 |
| JP | H8-300104 | A | | 11/1996 | |
| JP | H9-271897 | A | | 10/1997 | |
| JP | 2002-361368 | A | | 12/2002 | |
| JP | 2011-092964 | A | | 5/2011 | |
| JP | 2011-098364 | A | | 5/2011 | |
| JP | 2012-076116 | A | | 4/2012 | |
| WO | WO-2011/086712 | A1 | | 7/2011 | |
| WO | WO-2011/111241 | A1 | | 9/2011 | |
| WO | WO 2017/138161 | A1 | | 8/2017 | |

* cited by examiner

FLASKLESS MOLDING MACHINE

TECHNICAL FIELD

This disclosure relates to a flaskless molding machine.

BACKGROUND ART

Patent Document 1 discloses a flaskless molding machine that forms a flaskless type mold that does not have any flask. This molding machine includes: a pair of an upper flask and a lower flask; a match plate where a model is disposed; a supply mechanism that supplies mold sand; and a squeeze mechanism that compresses the mold sand. The molding machine moves the lower flask close to the upper flask, and causes the upper flask and the lower flask to clamp the match plate. In this state, the molding machine operates the supply mechanism, thereby supplying mold sand into upper and lower molding spaces formed by the upper flask and the lower flask. The molding machine operates the squeeze mechanism, thereby compressing the mold sand in the upper and lower molding spaces. Through the process described above, an upper mold and a lower mold are simultaneously formed.

The supply mechanism of the molding machine supplies the mold sand to the upper and lower molding spaces using compressed air. The supply mechanism includes a sand tank that stores mold sand. The sand tank communicates with a compressed air source. The sand tank has a first opening communicating with an introduction port of an upper molding space and a second opening communicating with an introduction port of a lower molding space, the openings being formed therebelow. The introduction port of the upper molding space and the introduction port of the lower molding space are formed on sides of the respective spaces. The sand tank is disposed so that its lower portion is positioned on the sides of the upper and lower molding spaces. The first opening of the sand tank communicates with the introduction port of the upper molding space, and the second opening of the sand tank communicates with the introduction port of the lower molding space. In this state, compressed air blown from the compressed air source supplies the mold sand stored in the sand tank, from the sides of the upper and lower molding spaces, into the upper and lower molding spaces.

CITATION LIST

Patent Document

Patent Document 1: Japanese Unexamined Patent Publication No. 2011-98364

SUMMARY OF INVENTION

Technical Problem

As for the flaskless molding machine described in Patent Document 1, since the thickness of a mold to be formed varies according to the model shape and the CB (compactability) of the mold sand, there is a possibility that the openings of the sand tank and the introduction ports of the molding spaces deviate from each other in the vertical direction. In this case, the flow of the mold sand is not uniform. Accordingly, there is a possibility that sand clogging occurs in the sand tank. Such sand clogging can be avoided by using mold sand having a low CB. However, the mold sand adjusted to have a low CB is not the optimal mold sand with respect to the moldabilities of the molds and the qualities of casting products in some cases. In this technical field, a flaskless molding machine that forms excellent molds and casting products is desired.

Solution to Problem

A flaskless molding machine according to one aspect of the present invention is a flaskless molding machine forming a flaskless upper mold and lower mold by filling, with mold sand, an upper molding space formed using an upper flask and a lower molding space formed using a lower flask, and by pressurizing the mold sand filled in the upper molding space and the lower molding space, including: an upper sand tank storing the mold sand to be supplied to the upper molding space; a first lower sand tank storing the mold sand to be supplied to the lower molding space, and having a first communication port for discharging the stored mold sand; a second lower sand tank having a second communication port capable of communicating with the first communication port of the first lower sand tank, and storing the mold sand supplied from the first lower sand tank and to be supplied to the lower molding space; at least one first guide member extending in a vertical direction, and guiding the upper flask, the lower flask and the second lower sand tank in the vertical direction; and a second guide member extending in the vertical direction, and guiding the first lower sand tank in the vertical direction.

In the flaskless molding machine, the upper flask, the lower flask and the second lower sand tank are guided in the vertical direction by at least one first guide member. That is, the upper flask and the lower flask for forming molds are moved while being guided by the common guide members. Accordingly, the inclinations of the flasks from the horizontal direction and deviation between the flasks can be suppressed. Furthermore, the second lower sand tank is moved while being guided by the first guide member, and the first lower sand tank is moved while being guided by the second guide member. As described above, the first lower sand tank and the second lower sand tank are moved by the separate guide members. Consequently, adjustment can be achieved so that the openings of the sand tank and the introduction ports of the molding spaces can coincide with each other in the vertical direction. Accordingly, the flow of mold sand at the communication portion between the first communication port and the second communication port becomes uniform, and occurrence of sand clogging can be suppressed. Consequently, the need to adjust the CB of mold sand in consideration of sand clogging is negated. The mold sand optimal to the moldability of a mold and the quality of a casting product can be used. Resultantly, the excellent mold and casting product can be obtained.

The flaskless molding machine according to one embodiment may further include: a drive unit configured to move the second lower sand tank in the vertical direction; and an adjustment drive unit configured to move the first lower sand tank in the vertical direction. In this case, the openings of the sand tank and the introduction ports of the molding spaces can be adjusted to coincide with each other in the vertical direction by the drive unit and the adjustment drive unit.

In one embodiment, at least one first guide member may include four first guide members, and the upper flask, the lower flask and the second lower sand tank may be movably attached to the four first guide members. In such a configuration, the movement of the upper flask, the lower flask and the second lower sand tank is stabilized. Accordingly, squeezing can be stably performed. Consequently, the performance of mold-stripping is improved. Resultantly, the excellent mold and casting product can be obtained.

In one embodiment, the four first guide members may be disposed in such a way to form a quadrangle with vertices residing at respective centers of the four first guide members, the quadrangle encircling the upper molding space and the lower molding space, when being viewed in the vertical direction, and the four first guide members may guide the upper flask, the lower flask and the second lower sand tank in the vertical direction at a sand filling time, a squeezing time and a mold-stripping time. As described above, in a case where the attitudes of the upper flask, the lower flask and the second lower sand tank are the same at the sand filling time, the squeezing time and the mold-stripping time, the four guides 12 can be disposed.

In one embodiment, the upper sand tank and the first lower sand tank may be provided with permeation members each having a plurality of pores on an inner surface thereof, the pores allowing the compressed air to flow. In such a configuration, the compressed air is supplied to a storage space from the side through the entire surfaces of the permeation members. Consequently, the fluidity of mold sand is improved. In this state, the mold sand is then blown into the upper flask or the lower flask by the compressed air, thereby allowing the blowing resistance of the mold sand to be reduced. Consequently, the power consumption of the compressed air source can be suppressed, and occurrence of sand clogging can be suppressed.

The CB of the mold sand with which the upper molding space and the lower molding space are filled may be set in a range from 30% to 42%. The compressive strength of the mold sand with which the upper molding space and the lower molding space are filled may be set in a range from 8 to 15 $N/cm^2$. In this case, an excellent mold and casting product can be obtained.

Advantageous Effects of Invention

According to the various aspects and embodiments of the present invention, a flaskless molding machine that forms excellent molds and casting products is provided.

DESCRIPTION OF EMBODIMENTS

Hereinafter, embodiments are described with reference to the drawings. The identical or corresponding portions in the diagrams are assigned identical signs, and redundant description is omitted. Hereinafter, the horizontal directions are assumed as X-axis and Y-axis directions, and the vertical direction (upward and downward direction) is assumed as a Z-axis direction.

[Frame Structure]

Figure 1:
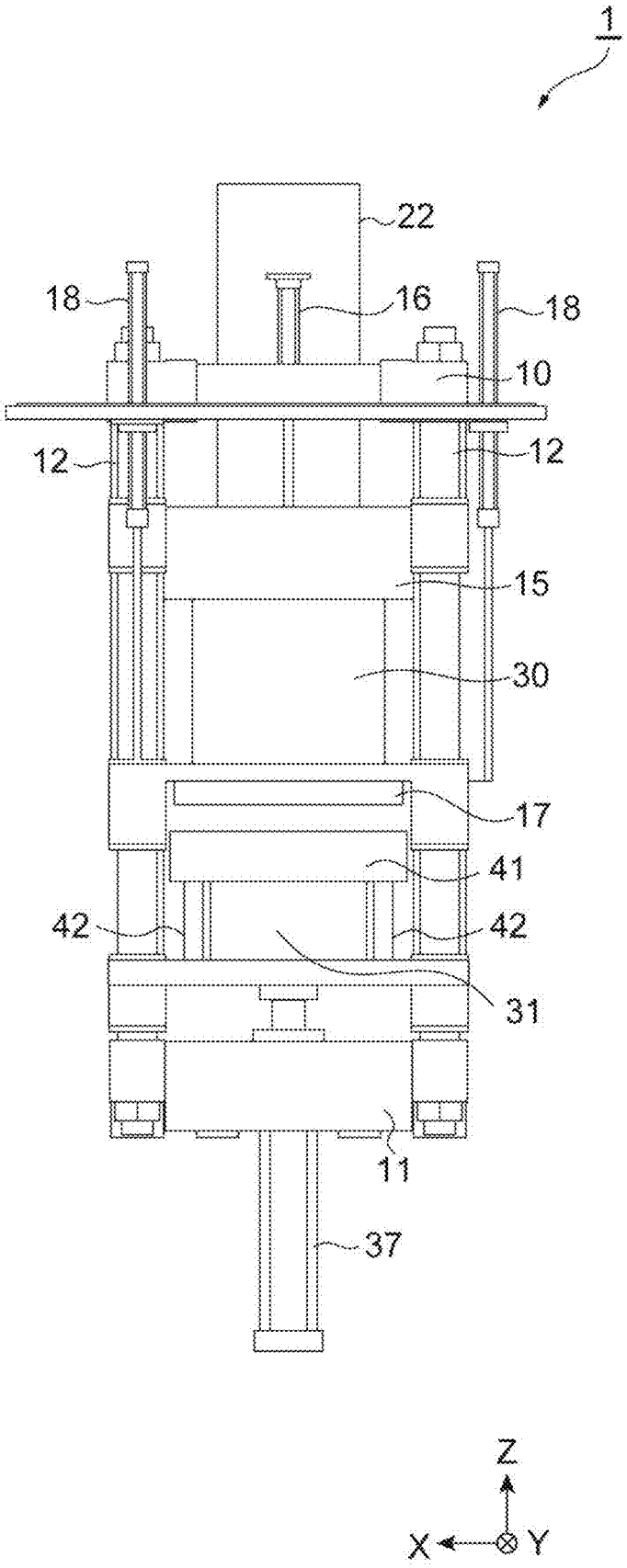
FIG. 1 is a front view of the flaskless molding machine according to one embodiment.
Figure 2:
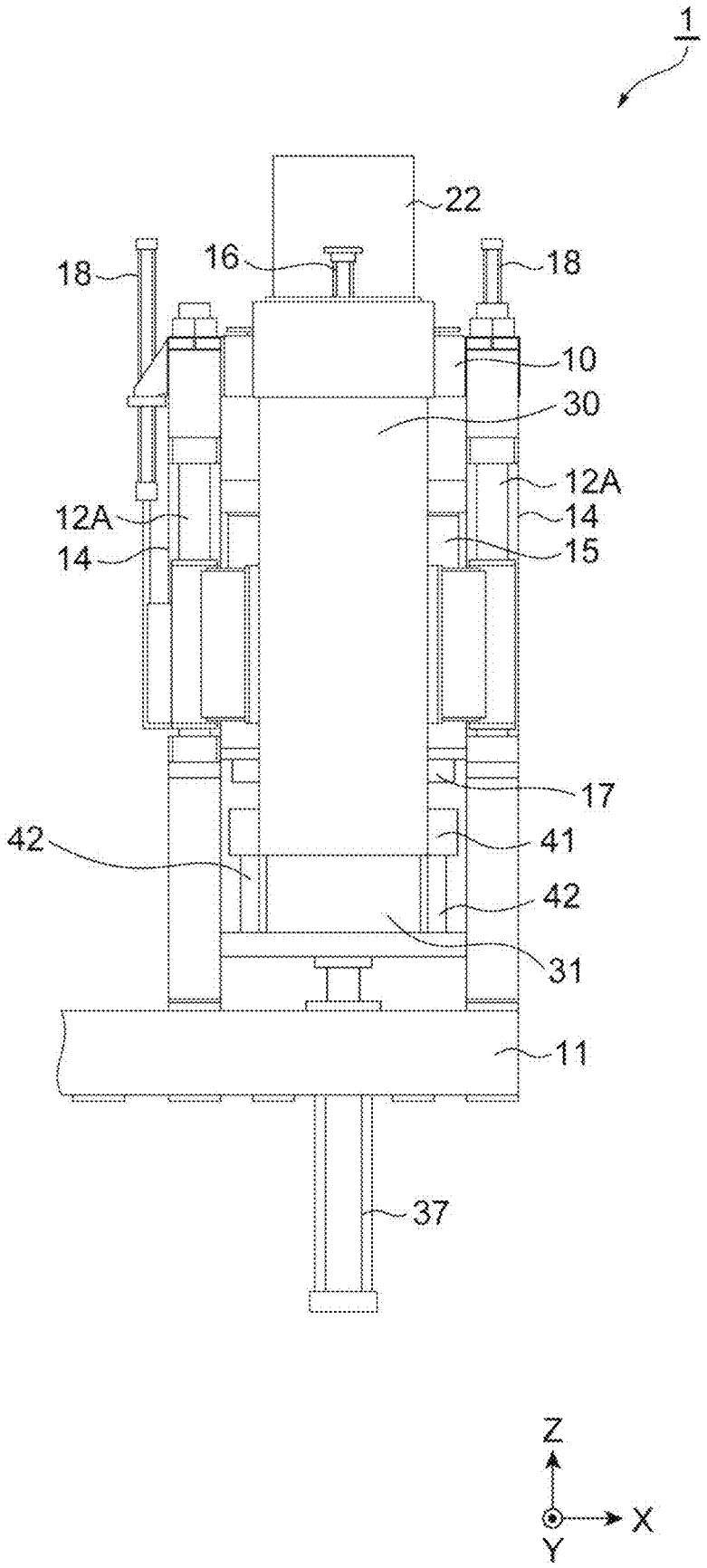
FIG. 2 is a rear view of the flaskless molding machine in FIG. 1.
Figure 3:
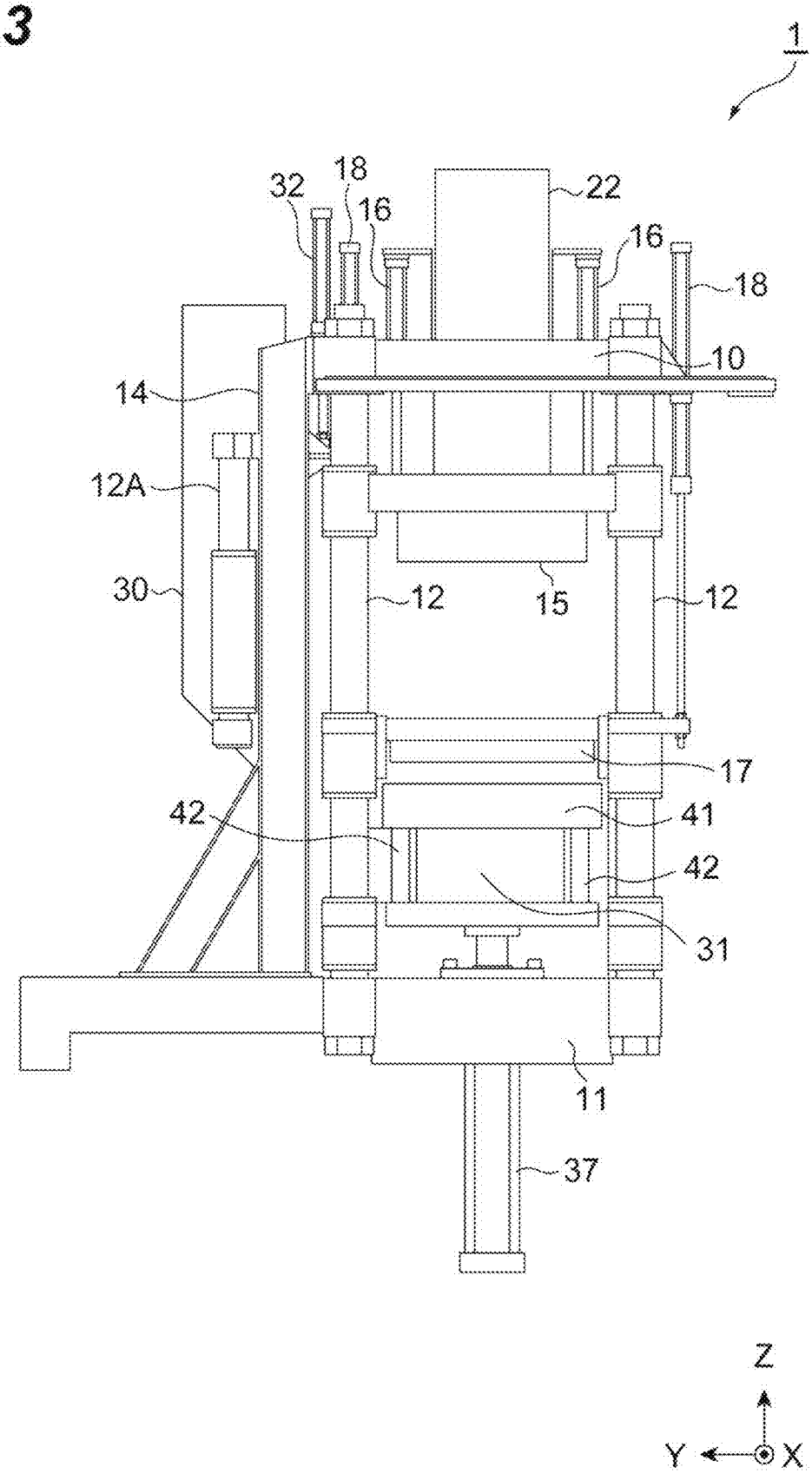
FIG. 3 is a left side view of the flaskless molding machine in FIG. 1.
Figure 4:
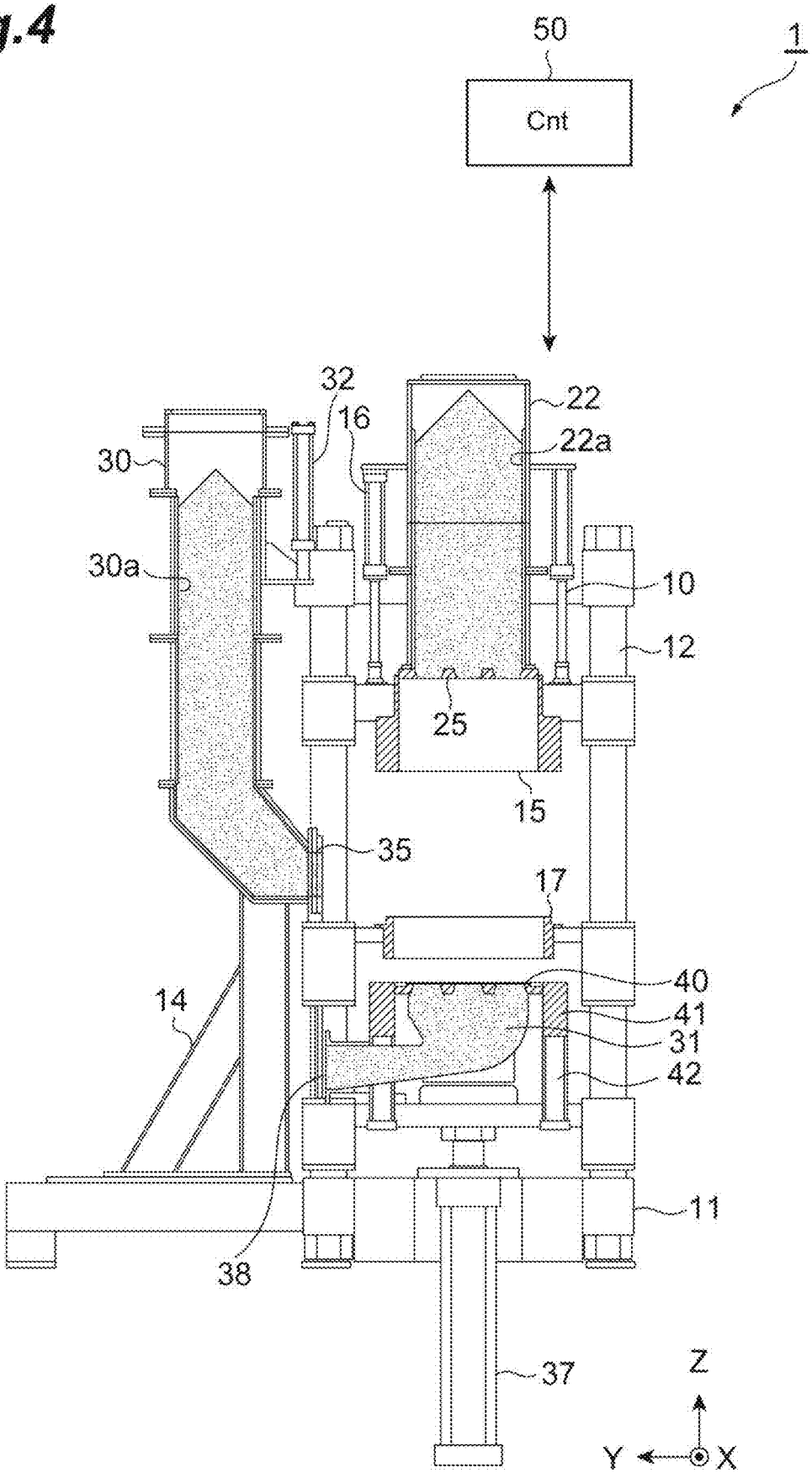
FIG. 4 is a schematic diagram of the left side view of the flaskless molding machine in FIG. 1.

The flaskless molding machine 1 according to this embodiment is a molding machine that forms a flaskless upper mold and lower mold. FIG. 1 is a front view of the flaskless molding machine 1 according to one embodiment. FIG. 2 is a rear view of the flaskless molding machine 1. FIG. 3 is a left side view of the flaskless molding machine 1. FIG. 4 is a schematic diagram of the left side view of the flaskless molding machine 1. As shown in FIGS. 1 to 4, the flaskless molding machine 1 includes an upper frame 10, a lower frame 11, and four guides (first guide member) 12 that couples the upper frame 10 and the lower frame 11. As for the guides 12, their upper ends are coupled to the upper frame 10, and their lower ends are coupled to the lower frame 11. The four guides 12 are disposed so that the quadrangle whose vertices reside at the respective centers of the four guides 12 can encircle an upper molding space and a lower molding space that are described later, when being viewed in the vertical direction. As described later, the four guides 12 guide the upper flask, the lower flask and the second lower sand tank in the vertical direction at a sand filling time, a squeezing time and a mold-stripping time. The lower frame 11 includes a portion extending outside of the molding position. A support frame 14 extending in the vertical direction is disposed at this portion. The support frame is provided with two guides (second guide member) 12A.

[Upper Flask and Lower Flask]

The flaskless molding machine 1 includes an upper flask 15. The upper flask 15 is a box-shaped frame where the upper end and the lower end are open. The upper flask 15 is movably attached to the four guides 12. The upper flask 15 is supported by an upper flask cylinder 16 attached to the upper frame 10, and vertically moves along the guides 12 according to the operation of the upper flask cylinder 16.

The flaskless molding machine 1 includes a lower flask 17 disposed below the upper flask 15. The lower flask 17 is a box-shaped frame where the upper end and the lower end are open. The lower flask 17 is movably attached to the four guides 12. The lower flask 17 is supported by two lower flask cylinders 18 attached to the upper frame 10, and vertically moves along the guides 12 according to the operation of the lower flask cylinders 18.

A match plate (not shown) is introduced between the upper flask 15 and the lower flask 17 by a conveyance unit (not shown). The match plate is a plate-shaped member with models being disposed on both the surfaces thereof, and moves to and from between the upper flask 15 and the lower flask 17. The upper flask 15 and the lower flask 17 can clamp the match plate, in the vertical direction.

[Sand Tank]

The flaskless molding machine 1 includes an upper sand tank 22 disposed above the upper flask 15. The upper sand tank 22 is attached to the upper frame 10. More specifically, the upper sand tank 22 is statically fixed to the upper frame 10. The upper sand tank 22 internally stores mold sand to be supplied to the upper flask 15. The upper sand tank 22 includes, at its upper end, an introduction port which can be opened and closed and through which the mold sand is supplied. The lower end of the upper sand tank 22 is open, and an upper plate 25 is attached to the opening at the lower end. The upper plate 25 is a plate-shaped member, and has at least one supply port through which the upper sand tank 22 and the inside of the upper flask 15 communicate with each other. The mold sand in the upper sand tank 22 is supplied through the supply port of the upper plate 25 into the upper flask 15. The upper plate 25 has a size substantially identical to the size of the opening of the upper flask 15. The upper flask 15 moves in the upward direction, thereby causing the upper plate 25 to enter the inside of the upper flask 15. The upper flask 15 moves in the downward direction, thereby retracting the upper plate 25 from the upper flask 15. As described above, the upper plate 25 is configured to be capable of entering and being retracted from the inside of the upper flask 15.

The upper sand tank 22 communicates with a compressed air source (not shown) and the compressed air at a predetermined pressure is supplied to the upper sand tank 22. The compressed air supplied from the upper portion of the upper sand tank 22 is blown toward the lower portion of the upper sand tank 22. The mold sand in the upper sand tank 22 is supplied, together with the compressed air, through the supply port of the upper plate 25 into the upper flask 15.

The upper sand tank 22 is provided, on its inner surface, with a permeation member 22*a* (FIG. 4) having a plurality of pores that allow the compressed air to pass. Accordingly, the compressed air is supplied through the entire surface of the permeation member 22*a* to the entire inner space, thereby improving the fluidity of the mold sand. The permeation member 22*a* may be formed of a porous material.

The flaskless molding machine 1 includes a lower sand tank that stores mold sand to be supplied into the lower flask 17. According to an example, the lower sand tank is divided into a first lower sand tank 30 and a second lower sand tank 31 (FIG. 4). The first lower sand tank 30 is disposed on a side of the upper sand tank 22. The first lower sand tank 30 internally stores mold sand to be supplied to the lower flask 17.

The first lower sand tank 30 is supported by the support frame 14, and is movably attached to two vertically extending guides 12A (FIGS. 2 and 3) provided for the support frame 14. More specifically, the first lower sand tank 30 is supported by a lower tank cylinder (adjustment drive unit) 32 attached to the support frame 14, and vertically moves along the guide 12A according to the operation of the lower tank cylinder 32.

The first lower sand tank 30 includes, at its upper end, an introduction port which can be opened and closed and through which the mold sand is supplied. The first lower sand tank 30 is bent at its lower end in the horizontal direction (the negative direction on the Y-axis), and, at its distal end, a first communication port 35 for discharging the stored mold sand is formed. The first communication port 35 is configured so that this port can communicate with an after-mentioned second communication port of the second lower sand tank 31 at a predetermined height (communication position). The mold sand is supplied through the first communication port 35 to the second lower sand tank 31.

The first lower sand tank 30 communicates with the compressed air source (not shown). The compressed air supplied from the upper portion of the first lower sand tank 30 is blown toward the lower portion of the upper sand tank 22. The compressed air is blown toward the lower portion of the first lower sand tank 30, and the mold sand in the first lower sand tank 30 is supplied together with the compressed air through the first communication port 35 into the second lower sand tank 31.

The first lower sand tank 30 is provided, on its inner surface, with a permeation member 30*a* having a plurality of pores that allow the compressed air to pass. Accordingly, the compressed air is supplied through the entire surface of the permeation member 30*a* to the entire inner space, thereby improving the fluidity of the mold sand. The permeation member 30*a* may be formed of a porous material.

The second lower sand tank 31 is disposed below the lower flask 17. The second lower sand tank 31 internally stores mold sand to be supplied to the lower flask 17. The second lower sand tank 31 is movably attached to the four guides 12, and is supported in a vertically movable manner by a vertically extending squeeze cylinder (drive unit) 37.

At a side portion of the second lower sand tank 31, a second communication port 38 that can communicate with the first communication port 35 of the first lower sand tank is formed. The second communication port 38 is configured so that this port can communicate with the first communication port 35 of the first lower sand tank 30 at a predetermined height (communication position). The communication position has a height at which the first communication port 35 and the second communication port 38 communicate with each other and, more specifically, is a position at which the first communication port 35 and the second communication port 38 are disposed concentrically with each other. The first communication port 35 and the second communication port 38 communicate with each other on a communication plane along the vertical direction.

Figure 5:
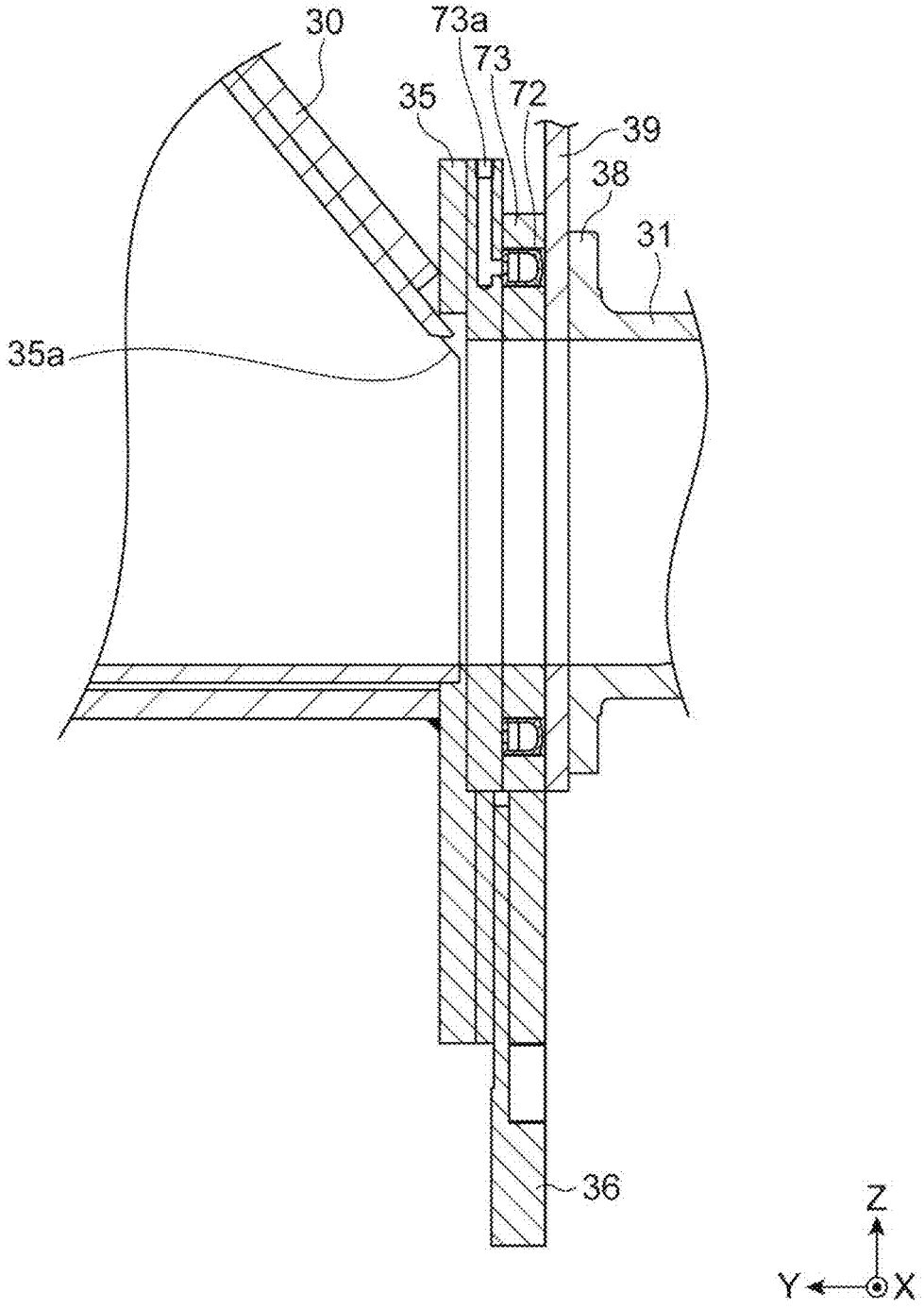
FIG. 5 is a partial sectional view in a state where a first lower sand tank and a second lower sand tank communicate with each other.
Figure 6:
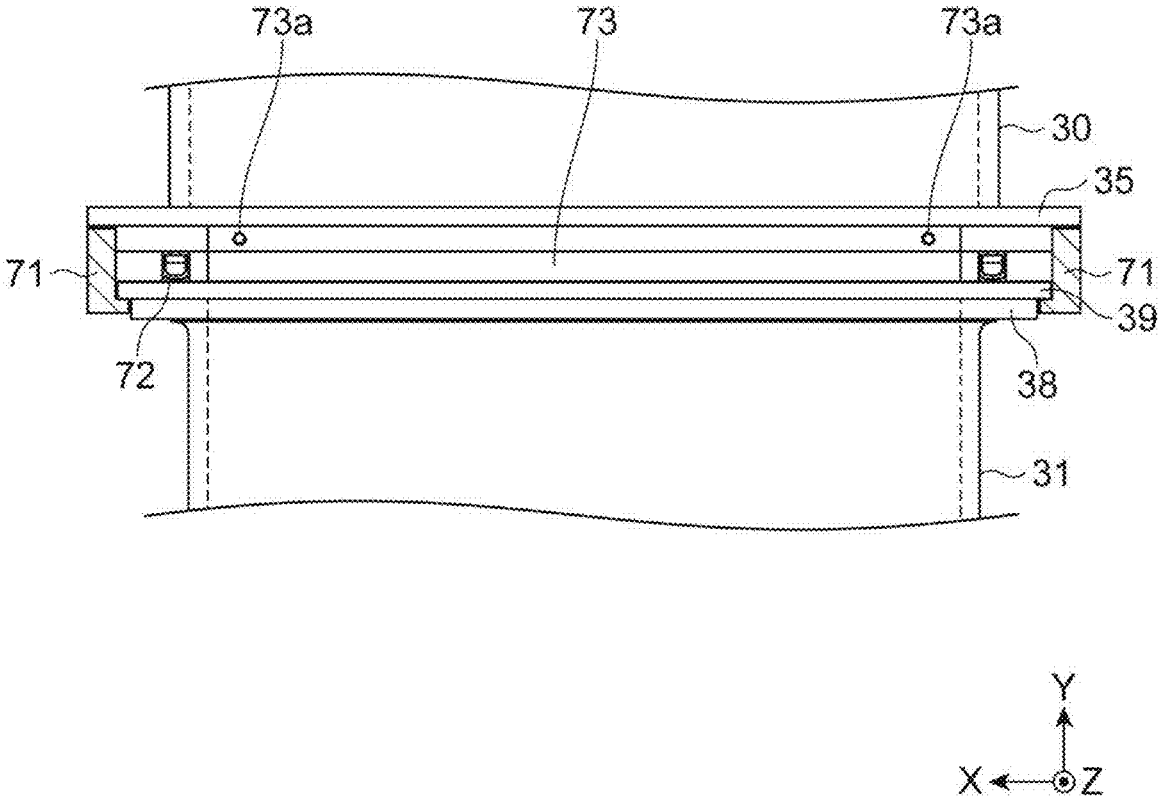
FIG. 6 is a plan view in the state where the first lower sand tank and the second lower sand tank communicate with each other.

FIG. 5 is a partial sectional view in the state where the first lower sand tank 30 and the second lower sand tank 31 communicate with each other. FIG. 6 is a plan view in the state where the first lower sand tank 30 and the second lower sand tank 31 communicate with each other. As shown in FIGS. 5 and 6, the first lower sand tank 30 and the second lower sand tank 31 are in a state of communicating with each other through communication between the first communication port 35 and the second communication port 38 being at the predetermined communication position. The mold sand is supplied through the first communication port 35 and the second communication port 38 from the first lower sand tank 30 to the second lower sand tank 31. The first communication port 35 of the first lower sand tank 30 is provided with a first block plate 36 that extends in the vertical direction. The second communication port 38 of the second lower sand tank 31 is provided with a vertically extending second block plate 39. The opposite sides of the first communication port 35 of the first lower sand tank 30 are provided with guide rails 71 (FIG. 6) that guide a second block plate 39. The second block plate 39 is guided by the guide rails 71, thereby allowing the first communication port 35 and the second communication port 38 to be guided to the communication position without being inclined from each other. When the first communication port 35 of the first lower sand tank 30 is not at the communication position, this port is shielded by the second block plate 39. When the second communication port 38 of the second lower sand tank 31 is not at the communication position, this port is shielded by the first block plate 36.

Figure 7:
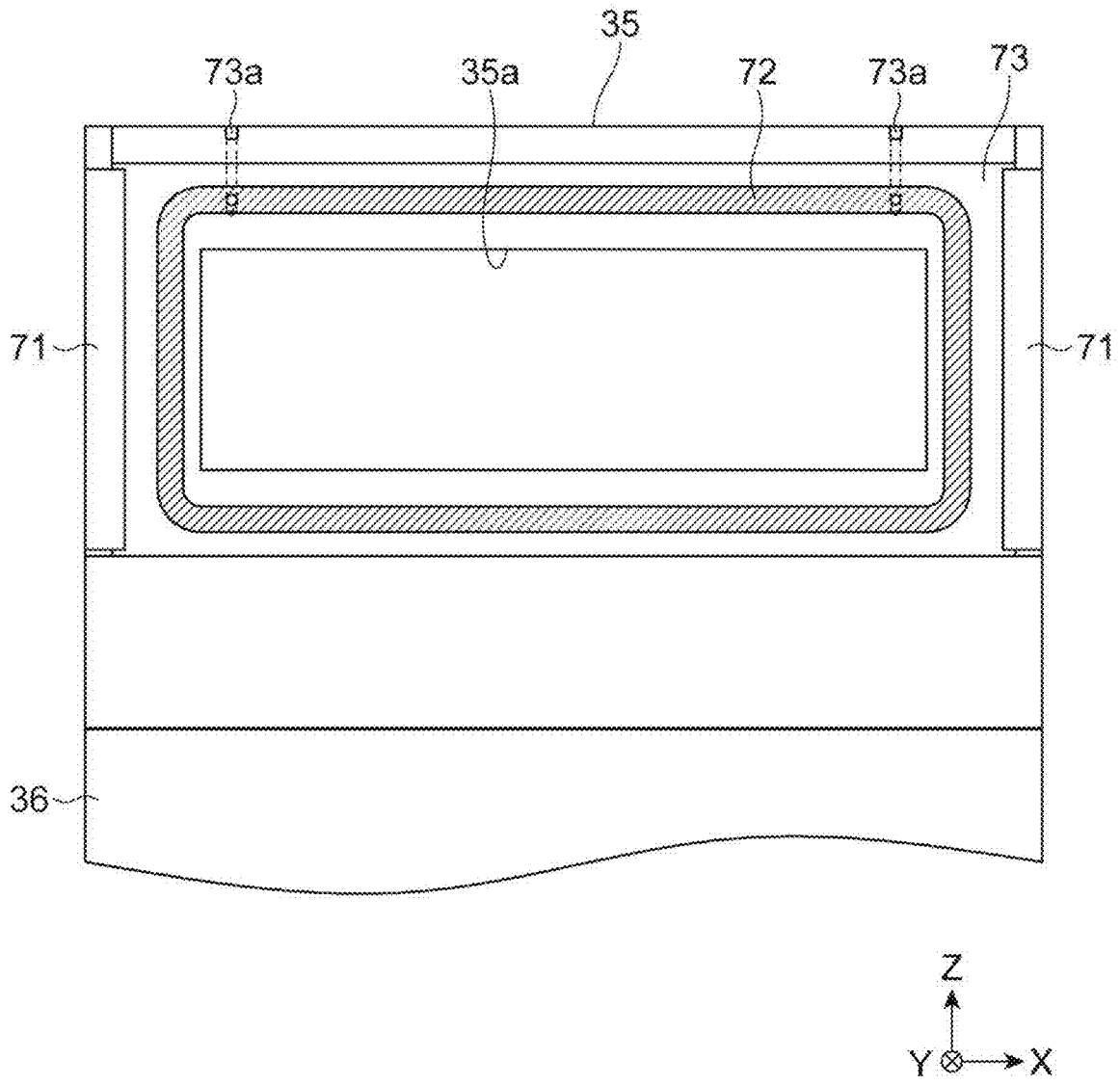
FIG. 7 is a schematic diagram of a first communication port of the first lower sand tank.
Figure 8:
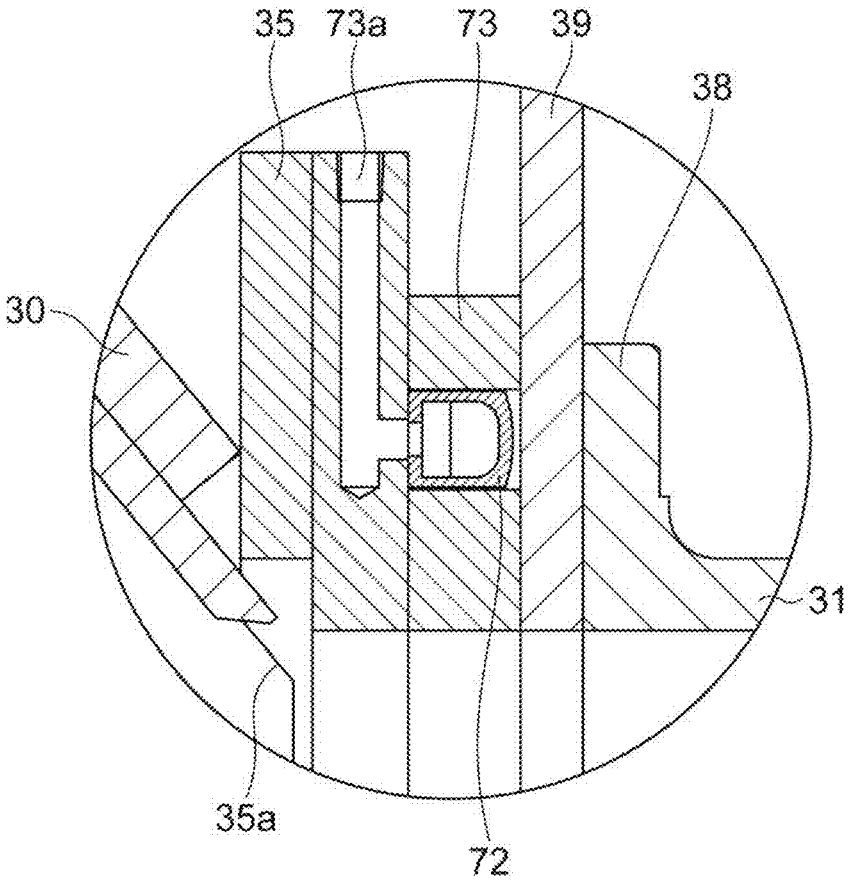
FIG. 8 is a partially enlarged sectional view of a sealing mechanism.

It should be noted that the flaskless molding machine 1 may include a sealing mechanism that hermetically seals the communication planes of the first communication port 35 and the second communication port 38. For example, the sealing mechanism is provided on the first communication port 35 side. FIG. 7 is a schematic diagram of the first communication port 35 of the first lower sand tank 30, and is a diagram showing the first communication port 35 from the open side. As shown in FIG. 7 the first communication port 35 has an opening 35*a* that communicates with the inside of the first lower sand tank 30. The sealing mechanism includes a sealing member 72 and a holding member 73. The sealing member 72 is an annular member that encircles the opening 35*a*. The sealing member 72 has a tubular shape that can guide gas into its inside, and has a flexibility. The holding member 73 is an annular member that encircles the opening 35*a*, and is in contact with the second block plate 39. A groove that can accommodate the sealing member 72 is formed on a surface of the holding member 73 with which the second block plate 39 is in contact. FIG. 8 is a partially enlarged sectional view of the sealing mechanism. As shown in FIG. 8, the sealing member 72 is accommodated to an extent not extruding from the surface of the holding member 73 with which the second block plate 39 is in contact. At the holding member 73, a gas guide port 73*a* (FIGS. 5 to 8) that communicates with the sealing member 72 is formed. The sealing member 72 is inflated when gas is introduced into its inside, and extrudes from the surface of the holding member 73 to enclose hermetically the communication planes of the first communication port 35 and the second communication port 38. It should be noted that the flaskless molding machine 1 may adopt a sealing mechanism other than the sealing mechanism shown in FIGS. 5 to 8.

The upper end of the second lower sand tank 31 is open, and a lower plate 40 (FIG. 3) is attached to the opening at the upper end. The lower plate 40 is a plate-shaped member, and has at least one supply port through which the second lower sand tank 31 and the inside of the lower flask 17 communicate with each other. The mold sand in the second lower sand tank 31 is supplied through the supply port of the lower plate 40 and an after-mentioned lower filling frame into the lower flask 17.

[Lower Filling Frame]

The flaskless molding machine 1 includes, for example, a lower filling frame 41 (FIGS. 1 to 4). The lower filling frame 41 is disposed below the lower flask 17. The lower filling frame 41 is a box-shaped frame where the upper end and the lower end are open. The opening at the upper end of the lower filling frame 41 communicates with the opening at the lower end of the lower flask 17. The lower filling frame 41 is configured so that its inside can accommodate the second lower sand tank 31. The lower filling frame 41 is supported in a vertically movable manner by a lower filling frame cylinder 42 fixed to the second lower sand tank 31. The lower plate 40 has a size substantially identical to each of the sizes of openings of the lower filling frame 41 and the lower flask 17. A position where the vertically movable lower filling frame 41 internally accommodates the second lower sand tank 31 and the lower plate 40 is an original position (initial position), and serves as a descending end. The lower filling frame 41 moves in the upward direction, thereby retracting the lower plate 40 from the lower filling frame 41. The lower filling frame 41 having moved in the upward direction is moved in the downward direction, thereby allowing the lower plate 40 to enter the inside of the lower filling frame 41. As described above, the lower plate 40 is configured to be capable of entering and being retracted from the inside of the lower filling frame 41 (movable to and from). The flaskless molding machine 1 can reduce the stroke of the lower flask 17 by including the lower filling frame 41. Consequently, the flaskless molding machine having a lower machine height can be achieved in comparison with a case of not including the lower filling frame 41. Furthermore, as the flaskless molding machine 1 can reduce the stroke of the lower flask 17 by including the lower filling frame 41, the molding time of the pair of the upper mold and the lower mold can be reduced.

It should be noted that the flaskless molding machine 1 does not necessarily include the lower filling frame 41. In this case, the lower plate 40 is configured to be capable of entering and being retracted from the inside of the lower flask 17 (movable to and from). The descending end of the vertically movable lower flask 17 is the original position (initial position). That is, the lower plate 40 enters the inside of the lower flask 17 by moving in the upward direction relatively more than the lower flask 17 moving in the upward direction. The lower plate 40 is retracted from the lower flask 17 by moving in the downward direction relatively more than the lower flask 17.

[Molding Space and Squeeze]

Figure 9:
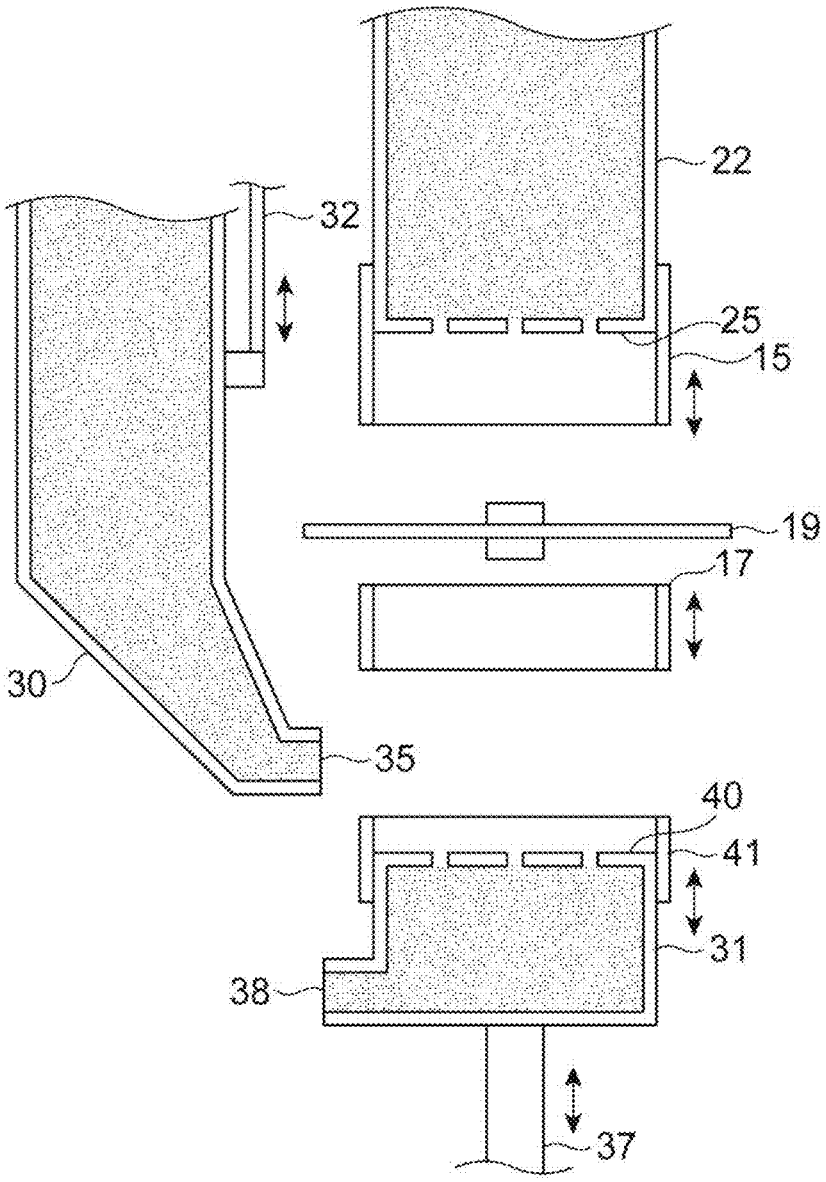
FIG. 9 is a diagram illustrating molding spaces and squeezing.
Figure 10:
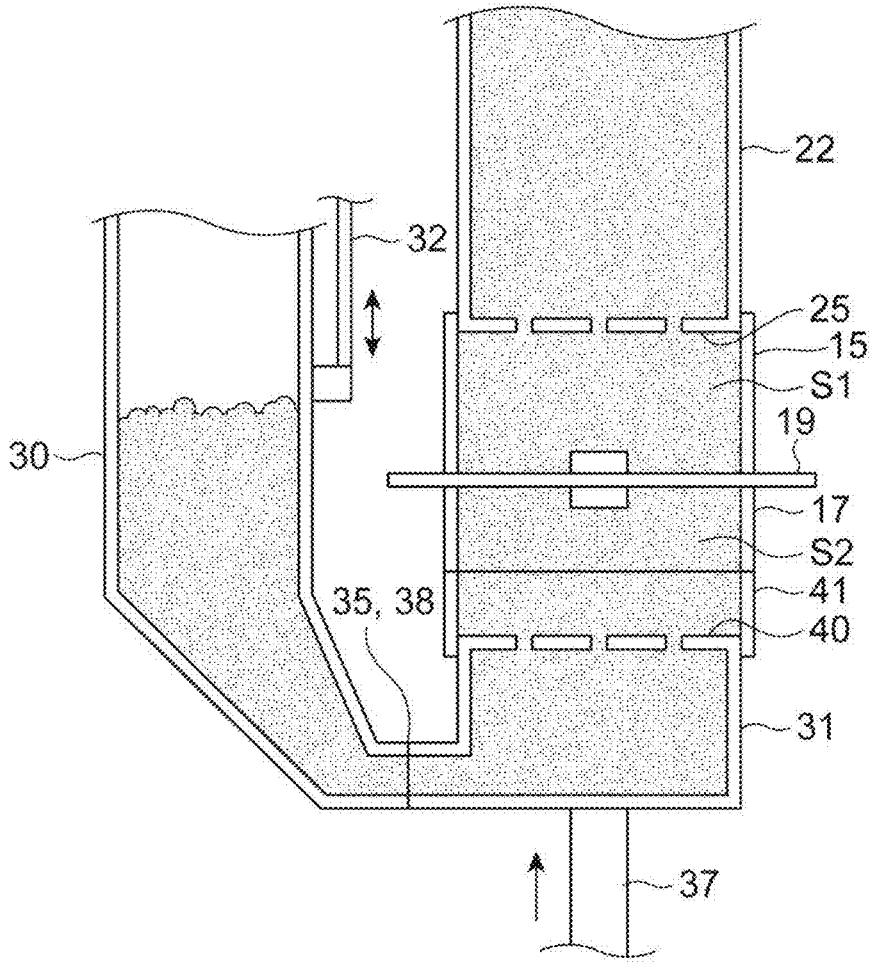
FIG. 10 is a diagram illustrating the molding spaces and squeezing.

FIGS. 9 and 10 are diagrams illustrating the molding spaces and squeezing. As shown in FIGS. 9 and 10, the match plate 19 is introduced between the upper flask 15 and the lower flask 17. The upper molding space S1 and the lower molding space S2 are formed when the upper flask cylinder 16, the lower flask cylinders 18 and the squeeze cylinder 37 are operated and the upper flask 15 and the lower flask 17 clamp the match plate at a predetermined height. The upper molding space S is formed by the upper plate 25, the upper flask 15 and the match plate. The lower molding space S2 is formed by the lower plate 40, the lower flask 17, the lower filling frame 41 and the match plate 19. In a case where the flaskless molding machine 1 includes the lower filling frame 41, the lower molding space may be formed by the lower plate 40, the lower flask 17 and the match plate 19.

The upper molding space S1 is filled with the mold sand stored in the upper sand tank 22, through the upper plate 25. The lower molding space S2 is filled with the mold sand stored in the second lower sand tank 31, through the lower plate 40. A time when the upper molding space S1 and the lower molding space S2 are formed and these spaces are filled with the mold sand is called the sand filling time. The CB of the mold sand with which the upper molding space S1 and the lower molding space S2 are filled may be set in a range from 30% to 42%. The compressive strength of the mold sand with which the upper molding space S1 and the lower molding space S2 are filled may be set in a range from 8 to 15 $N/cm^2$. It should be noted that as the thickness of the mold to be formed is changed according to the model shape and the CB (compactability) of the mold sand, the height of a target of the second lower sand tank 31 is changed according to the thickness of the mold. Accordingly, the height of the second communication port 38 of the second lower sand tank 31 is changed. Consequently, the height of the first communication port 35 of the first lower sand tank 30 is adjusted to be at the communication position of the second communication port 38 of the second lower sand tank 31 by the lower tank cylinder 32. Such adjustment can be achieved by a control device 50 (FIG. 4). The control device 50 is a computer that includes a control unit such as a processor, a storage unit such as a memory, an input and output unit such as an input device and a display device, and a communication unit such as a network card, and controls each of units of the flaskless molding machine 1, for example, a mold sand supply system, a compressed air supply system, a drive system, a power source system and the like.

In a state where the upper molding space S1 and the lower molding space S2 are filled with the mold sand, the squeeze cylinder 37 performs squeezing with the upper plate 25 and the lower plate 40 by moving the second lower sand tank 31 upward. Accordingly, a pressure is applied to the mold sand in the upper molding space S1, and the upper mold is formed. At the same time, a pressure is applied to the mold sand in the lower molding space S2, and the lower mold is formed. It should be noted that a time when the pressure is applied to the mold sand is called the squeezing time, and a time when the formed mold is stripped from the flask is called the mold-stripping time.

As described above, according to the flaskless molding machine 1 according to this embodiment, the upper flask 15, the lower flask 17 and the second lower sand tank 31 are supported movably in the vertical direction by the four guides 12. That is, the upper flask 15 and the lower flask 17 for forming molds are moved while being guided by the common guides 12. Accordingly, the inclinations of the flasks from the horizontal direction and deviation between the flasks can be suppressed. Accordingly, squeezing can be stably performed. Consequently, the performance of mold-stripping is improved. Resultantly, the excellent mold and casting product can be obtained. Furthermore, the second lower sand tank 31 is moved while being guided by the guides 12, and the first lower sand tank 30 is moved while being guided by the guides 12A. As described above, the first lower sand tank 30 and the second lower sand tank 31 are moved by the separate guide members. Consequently, adjustment can be achieved so that the openings of the sand tank and the introduction ports of the molding spaces can coincide with each other in the vertical direction. Accordingly, the flow of mold sand at the communication portion between the first communication port 35 and the second communication port 38 becomes uniform, and occurrence of sand clogging can be suppressed. Consequently, the need to adjust the CB of mold sand in consideration of sand clogging is negated. The mold sand optimal to the moldability of a mold and the quality of a casting product can be used. Resultantly, the excellent mold and casting product can be obtained.

Furthermore, the flaskless molding machine 1 according to this embodiment can facilitate adjustment of communication between the first lower sand tank 30 and the second lower sand tank 31, achieve the mold sand filling accuracy, and reduce the time required for filling. Furthermore, there is no need to move integrally the first lower sand tank 30 and the second lower sand tank 31. Consequently, the individual drive mechanisms can be reduced in size, and reduce the drive electric power.

Furthermore, the flaskless molding machine 1 according to this embodiment can allow the squeeze cylinder 37 and the lower tank cylinder 32 to adjust the openings of the sand tank and the introduction ports of the molding spaces to coincide with each other in the vertical direction.

Furthermore, in the flaskless molding machine 1 according to this embodiment, the upper flask 15, the lower flask 17 and the second lower sand tank 31 are movably attached to the four guides 12. The four guides 12 are disposed so that the quadrangle whose vertices reside at the respective centers of the four guides 12 can encircle the molding spaces (the upper molding space S1 and the lower molding space S2) formed using the upper flask 15 and the lower flask 17, when being viewed in the vertical direction. The four guides 12 guide the upper flask 15, the lower flask 17 and the second lower sand tank 31 in the vertical direction during filling with sand, squeezing, and model releasing. As described above, in a case where the attitudes of the upper flask 15, the lower flask 17 and the second lower sand tank 31 are the same during filling with sand, squeezing, and model releasing, the four guides 12 can be disposed.

Furthermore, the flaskless molding machine 1 according to this embodiment supplies the compressed air to the storage space from the side through the entire surfaces of the permeation members 22*a* and 30*a*. Consequently, the fluidity of mold sand is improved. In this state, the mold sand is then blown into the upper flask 15 or the lower flask 17 by the compressed air, thereby allowing the blowing resistance of the mold sand to be reduced. Consequently, the power consumption of the compressed air source can be suppressed, and occurrence of sand clogging can be suppressed.

In the flaskless molding machine 1 according to this embodiment, the mold sand with which the upper molding space S1 and the lower molding space S2 are to be filled is mold sand configured to be in a range where the CB of 30% to 42% and the compressive strength of mold sand of 8 to 15 $N/cm^2$. Consequently, the excellent mold and casting product can be obtained.

It should be noted that the embodiment described above is an example of the flaskless molding machine according to the present invention. The flaskless molding machine according to the present invention is not limited to the flaskless molding machine 1 according to the embodiment, and may be what is achieved by modifying the flaskless molding machine 1 according to the embodiment or by application to another machine in a range without changing the gist described in each claim.

For example, in the embodiment described above, the example where the flaskless molding machine 1 includes the four guides 12 is described. However, the flaskless molding machine 1 is only required to include at least one guide 12. That is, if the upper flask 15 and the lower flask 17 are guided by the common guide member, the inclination of the flasks from each other and the deviation of the flasks from each other can be suppressed.

Furthermore, in the embodiment described above, the example where the flaskless molding machine 1 includes the two guides 12A is described. However, the flaskless molding machine 1 is only required to include at least one guide 12A. That is, only if the guide 12A different from the guide 12 participating in squeezing is provided, adjustment can be achieved so that the openings of the sand tank and the introduction ports of the molding spaces can coincide with each other in the vertical direction.

In the embodiment described above, the example where the upper sand tank 22 is fixed to the upper frame 10 is described. Alternatively, the upper sand tank 22 may be configured to be movable. Furthermore, in the embodiment described above, the squeeze cylinder 37 may be disposed on the upper sand tank 22 side and a squeeze force may be applied on the upper side, or squeeze forces may be applied in the upper and lower directions using the squeeze cylinder 37 and the squeeze cylinder disposed on the upper sand tank 22 side.

REFERENCE SIGNS LIST

1 . . . Flaskless molding machine, 12 . . . Guide (first guide member), 12A . . . Guide (second guide member), 15 . . . Upper flask, 16 . . . Upper flask cylinder, 17 . . . Lower flask, 18 . . . Lower flask cylinder, 19 . . . Match plate, 22 . . . Upper sand tank, 25 . . . Upper plate, 22*a*, 30*a* . . . Permeation member, 30 . . . First lower sand tank, 31 . . . Second lower sand tank, 32 . . . Lower tank cylinder, 35 . . . First communication port, 37 . . . Squeeze cylinder, 38 . . . Second communication port, 40 . . . Lower plate, 41 . . . Lower filling frame, 42 . . . Lower filling frame cylinder, 50 . . . Control device.

The invention claimed is:

1. A flaskless molding machine forming a flaskless upper mold and lower mold by filling, with mold sand, an upper molding space formed using an upper flask and a lower molding space formed using a lower flask, and by pressurizing the mold sand filled in the upper molding space and the lower molding space, comprising:

an upper sand tank storing the mold sand to be supplied to the upper molding space;

a first lower sand tank storing the mold sand to be supplied to the lower molding space, and having a first communication port for discharging the stored mold sand;

a second lower sand tank having a second communication port capable of communicating with the first communication port of the first lower sand tank, and storing the mold sand supplied from the first lower sand tank and to be supplied to the lower molding space;

at least one first guide member extending in a vertical direction, and guiding the upper flask, the lower flask and the second lower sand tank in the vertical direction; and a second guide member extending in the vertical direction, and guiding the first lower sand tank in the vertical direction, wherein the upper flask, the lower flask, and the second lower sand tank are movably attached to the at least one first guide member, wherein the first communication port and the second communication port communicate with each other on a communication plane along the vertical direction, a distal end of the first lower sand tank where the first communication port is formed is fixedly provided with a first block plate extending downwardly from a lower end of the first communication port, and a side portion of the second lower sand tank where the second communication port is formed is fixedly provided with a second block plate extending upwardly from an upper end of the second communication port, wherein, the first block plate moves relative to the second communication port and the second block plate moves relative to the first communication port, and the first block plate moves integrally with the first lower sand tank, and the second block plate moves integrally with the second lower sand tank, wherein the first connection port is provided with a guide rail for guiding the second blocking plate in the vertical direction.

2. The flaskless molding machine according to claim 1, further comprising:

a drive unit configured to move the second lower sand tank in the vertical direction; and an adjustment drive unit configured to move the first lower sand tank in the vertical direction.

3. The flaskless molding machine according to claim 1, wherein the at least one first guide member includes four first guide members, and the upper flask, the lower flask and the second lower sand tank are movably attached to the four first guide members.

4. The flaskless molding machine according to claim 3, wherein the four first guide members are disposed in such a way to form a quadrangle with vertices residing at respective centers of the four first guide members, the quadrangle encircling the upper molding space and the lower molding space, when being viewed in the vertical direction, and the four first guide members guide the upper flask, the lower flask and the second lower sand tank in the vertical direction at a sand filling time, a squeezing time and a mold-stripping time.

5. The flaskless molding machine according to claim 1, wherein the upper sand tank and the first lower sand tank are provided with permeation members each having a plurality of pores on an inner surface thereof, the pores allowing compressed air to flow.

6. The flaskless molding machine according to claim 1, wherein a CB of the mold sand filled in the upper molding space and the lower molding space ranges from 30% to 42%.

7. The flaskless molding machine according to claim 1, wherein a compressive strength of the mold sand filled in the upper molding space and the lower molding space ranges from 8 to 15 N/cm$^2$.

8. The flaskless molding machine according to claim 2, wherein the at least one first guide member includes four first guide members, and the upper flask, the lower flask and the second lower sand tank are movably attached to the four first guide members.

9. The flaskless molding machine according to claim 2, wherein the upper sand tank and the first lower sand tank are provided with permeation members each having a plurality of pores on an inner surface thereof, the pores allowing compressed air to flow.

10. The flaskless molding machine according to claim 3, wherein the upper sand tank and the first lower sand tank are provided with permeation members each having a plurality of pores on an inner surface thereof, the pores allowing compressed air to flow.

11. The flaskless molding machine according to claim 4, wherein the upper sand tank and the first lower sand tank are provided with permeation members each having a plurality of pores on an inner surface thereof, the pores allowing compressed air to flow.

12. The flaskless molding machine according to claim 2, wherein a CB of the mold sand filled in the upper molding space and the lower molding space ranges from 30% to 42%.

13. The flaskless molding machine according to claim 3, wherein a CB of the mold sand filled in the upper molding space and the lower molding space ranges from 30% to 42%.

14. The flaskless molding machine according to claim 4, wherein a CB of the mold sand filled in the upper molding space and the lower molding space ranges from 30% to 42%.

15. The flaskless molding machine according to claim 5, wherein a CB of the mold sand filled in the upper molding space and the lower molding space ranges from 30% to 42%.

16. The flaskless molding machine according to claim 2, wherein a compressive strength of the mold sand filled in the upper molding space and the lower molding space ranges from 8 to 15 N/cm$^2$.

17. The flaskless molding machine according to claim 3, wherein a compressive strength of the mold sand filled in the upper molding space and the lower molding space ranges from 8 to 15 N/cm$^2$.

18. The flaskless molding machine according to claim 4, wherein a compressive strength of the mold sand filled in the upper molding space and the lower molding space ranges from 8 to 15 N/cm$^2$.

19. The flaskless molding machine according to claim 5, wherein a compressive strength of the mold sand filled in the upper molding space and the lower molding space ranges from 8 to 15 $N/cm^2$.

* * * * *